United States Patent [19]

Pettersson

[11] Patent Number: 4,595,240

[45] Date of Patent: Jun. 17, 1986

[54] COMBINED BUCKET AND FROZEN SOIL SCARIFIER

[75] Inventor: Stig Pettersson, Iggesund, Sweden

[73] Assignee: Logos Export AB, Hudiksvall, Sweden

[21] Appl. No.: 460,241

[22] PCT Filed: May 18, 1982

[86] PCT No.: PCT/SE82/00179

§ 371 Date: Jan. 17, 1983

§ 102(e) Date: Jan. 17, 1983

[87] PCT Pub. No.: WO82/04085

PCT Pub. Date: Nov. 25, 1982

[30] Foreign Application Priority Data

May 21, 1981 [SE] Sweden ..... 8103229
Jul. 6, 1981 [SE] Sweden ..... 8104199

[51] Int. Cl.[4] ..... E02F 5/32

[52] U.S. Cl. ..... 299/24; 299/36; 299/40; 299/67; 37/117.5; 405/180

[58] Field of Search ..... 299/24, 25, 36, 37, 299/67, 40; 37/117.5; 414/694, 697; 405/179, 180, 183

[56] References Cited

U.S. PATENT DOCUMENTS

| | | | |
|---|---|---|---|
| 3,209,474 | 10/1965 | Artman | 37/117.5 |
| 3,209,475 | 10/1965 | Salna | 37/117.5 |
| 3,343,693 | 9/1967 | Becker | 414/694 |
| 3,344,540 | 10/1967 | Ulrich | 37/117.5 |
| 3,486,344 | 12/1969 | Ylinen | 405/180 |
| 3,854,608 | 12/1974 | Arnold | 37/117.5 X |
| 3,959,900 | 6/1976 | Luck | 37/117.5 |
| 4,076,314 | 2/1978 | Dodich | 299/40 |

FOREIGN PATENT DOCUMENTS

| | | | |
|---|---|---|---|
| 0703629 | 12/1979 | U.S.S.R. | 37/117.5 |

*Primary Examiner*—Stephen J. Novosad
*Assistant Examiner*—Michael A. Goodwin
*Attorney, Agent, or Firm*—Nies, Webner, Kurz & Bergert

[57] ABSTRACT

A device at a combined bucket and frozen soil scarifier (/cable plough), where the bucket (13) and scarifier (10) are intended to be attached to a digger arm of an excavator or corresponding machine, and the width of the scarifier (10) is substantially smaller than the width of the bucket (10), and the bucket in digging position is intended to rest at its rear edge (14) against the scarifier (10), and the bucket at its upper portion is hingedly suspended by means of an axle (19) or corresponding member, and preferably by hydraulic means, for example at least one hydraulic cylinder (21), can be folded in the direction from the scarifier, whereby the scarifier can be utilized without the bucket being engaged.

The device according to the invention is especially characterized in that a separate attachment (1–6,43,44) is provided, which preferably by means of a quick-coupling arrangement (3–6) is attached to a corresponding controllable attachment on the digger arm, and that the bucket (13) and scarifier (10) are located at and project downward from said separate attachment, so that the bucket and scarifier, in relation to the longitudinal direction of the digger arm, can assume either of two positions offset through 180° in relation to each other.

15 Claims, 9 Drawing Figures

COMBINED BUCKET AND FROZEN SOIL SCARIFIER

Figure 1:
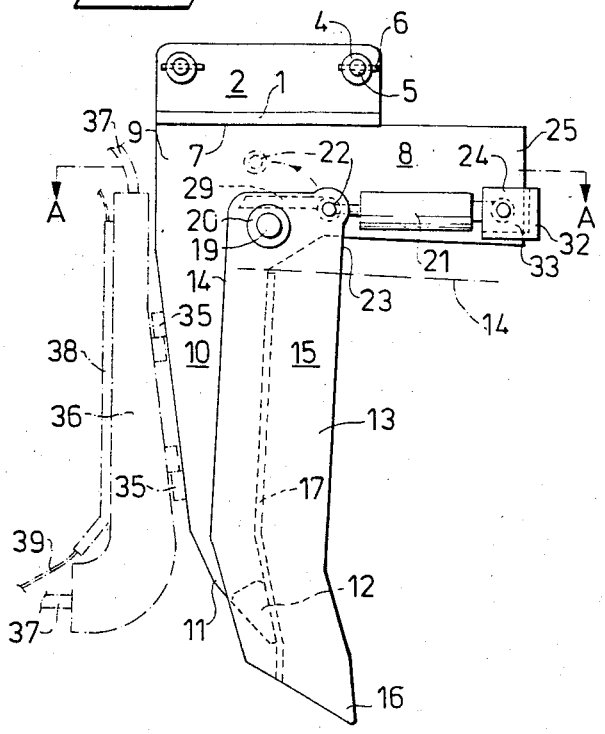

This invention relates to a bucket to be attached to the dipper arm of an excavator or corresponding machine, at which arm also a so-called frozen soil scarifier or cable plough is provided, so that it is possible by means of this combined arrangement of bucket and scarifier both to excavate with the bucket and to scarify frozen soil or corresponding material with the scarifier without excavating with the bucket.

Telecommunication cables, electric cables or the like often are laid in cable trenches or pipe trenches in the ground. The width of these trenches is substantially smaller than their depth. The trenches are digged a.o. by means of a cable plough or scarifier, which is attached to an excavator or corresponding machine and consists of a relatively narrow, slightly curved arm, which at its free end is provided with a tooth or the like, and a trench is digged or ploughed by means of the arm. The arm is adapted to digging in frozen soil and also is used for scarifying holes in the frozen soil before digging with a bucket can commence.

Arrangements are known, for example, where a frozen soil scarifier and a bucket are intended to be attached to the digger arm of an excavator and where, when the scarifier is to be used, the bucket is removed manually for rendering free use of the scarifier possible. These arrangements show several disadvantages, as they require, for example, heavy and tedious manual working moments.

The present invention relates to a combined bucket and frozen soil scarifier/cable plough, at which the aforesaid disadvantages have been eliminated and where the switching between scarifying/ploughing and digging, or vice versa, can be effected rapidly and automatically. According to the invention, also single objects such as a stone or log can be gripped by co-operation between the bucket and scarifier. According to one embodiment of the invention, the bucket and the scarifier are hingedly suspended at said attachment and can be rotated, swung outward, so that an object, for example a log, gripped by the bucket and scarifier can be swung in a plane from horizontal to, for example, vertical direction.

The present invention, thus, relates to a device at a combined bucket and frozen soil scarifier/cable plough, where the bucket and the scarifier are intended to be attached to a digger arm of an excavator or corresponding machine, and where the width of the scarifier is substantially smaller than the width of the bucket, and where the bucket in digging position is intended to rest at its rear edge against the scarifier, and where the bucket is hingedly suspended at its upper portion by means of an axle or corresponding member and can be folded, preferably by hydraulic means, in the direction from the scarifier, whereby the scarifier can be used without the bucket being engaged.

The device according to the invention is substantially characterized in that a separate attachment is provided to be attached, preferably by a quick-coupling arrangement, to a corresponding controllable attachment means at the digger arm, and that the bucket and the scarifier are located at said separate attachment and extend downward therefrom, so that the bucket and the scarifier can assume either of two positions, which are offset through 180° relative to each other in relation to the longitudinal direction of the digger arm.

Figure 2:
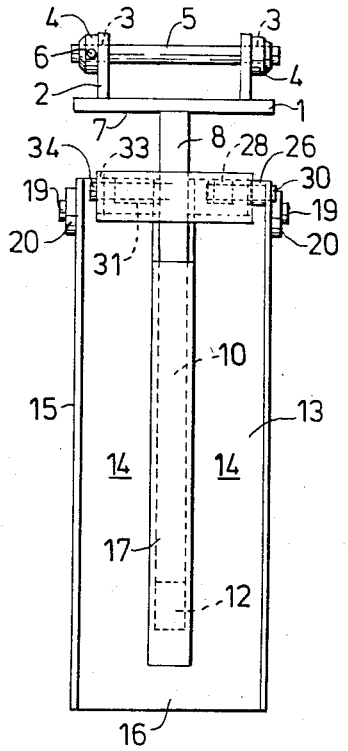
Figure 3:
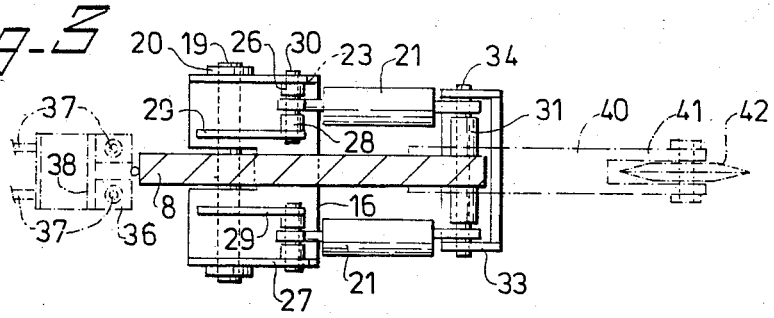
Figure 4:
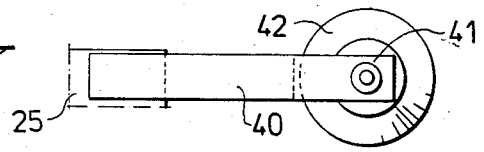
Figure 5:
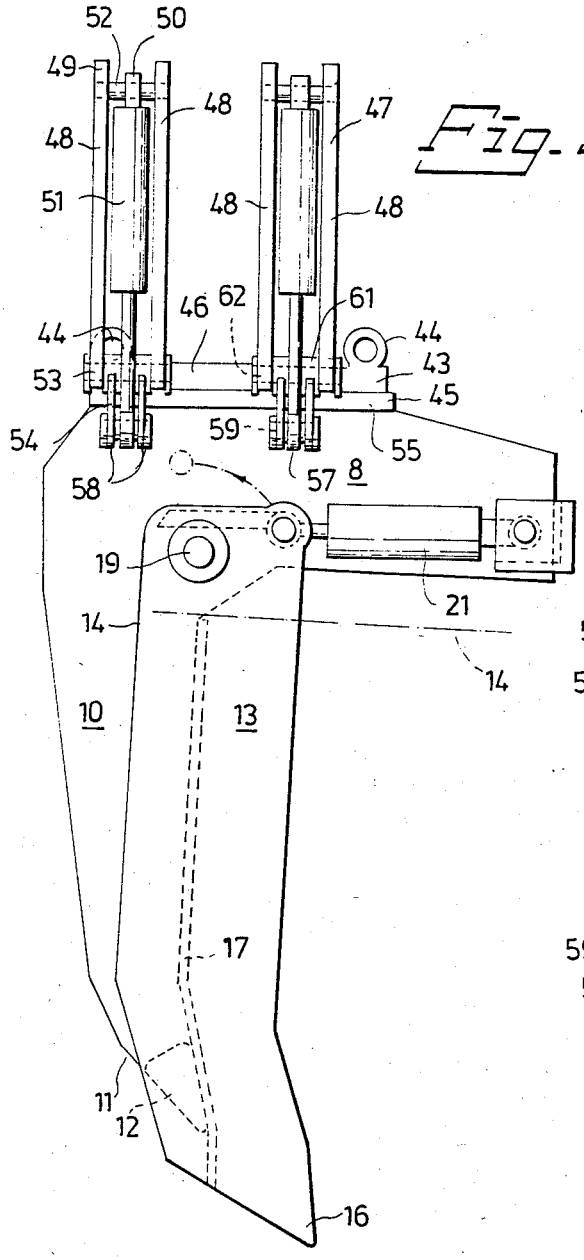
Figure 6:
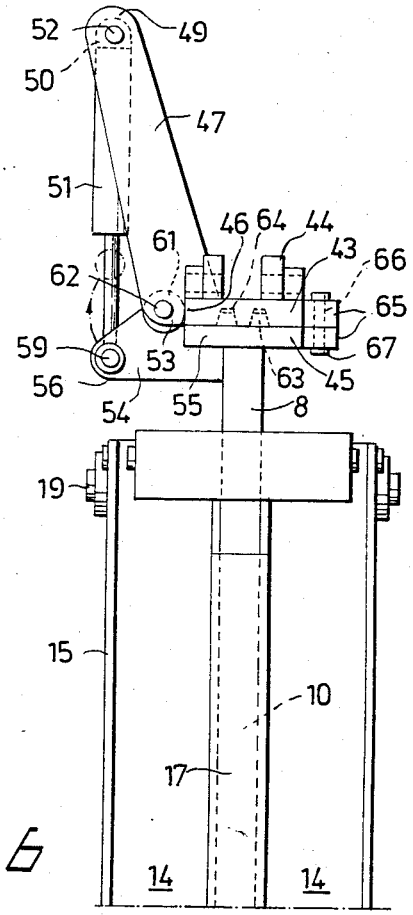
Figure 7:
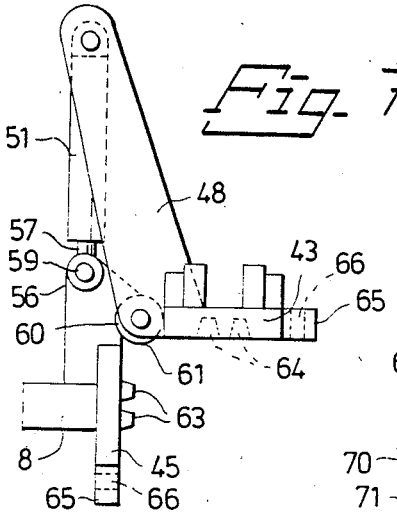
Figure 8:
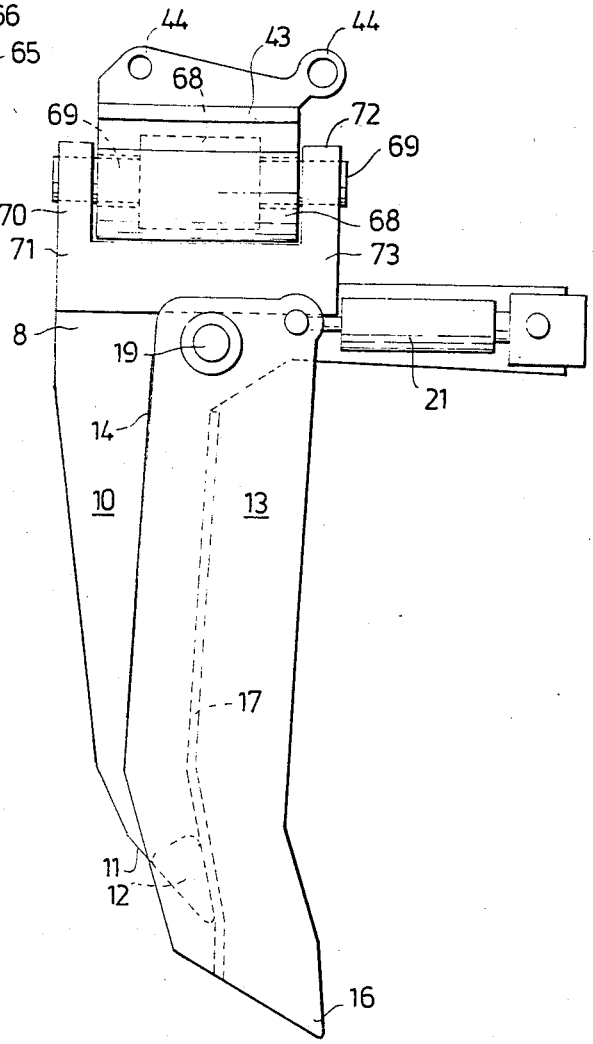
Figure 9:
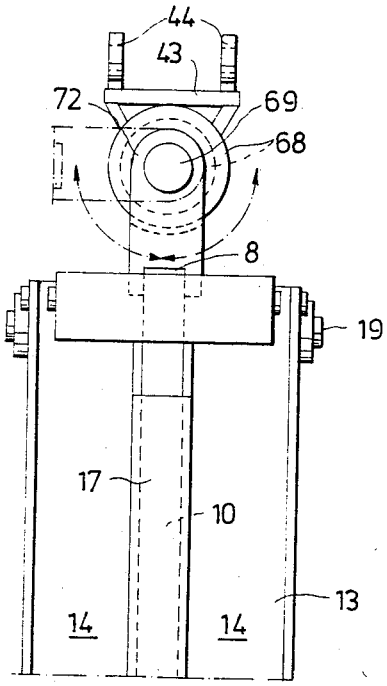

The invention is described in greater detail in the following, with reference to the accompanying drawings, in which FIG. 1 is a schematic lateral view of a device according to the invention, FIG. 2 is a view from the right in FIG. 1 of the device according to FIG. 1, where certain details have been excluded for the sake of clearness, and where to the right in FIG. 2 the forward cylinder attachments, and to the left in FIG. 2 the rearward cylinder attachments are shown, FIG. 3 is a section A—A in FIG. 1, FIG. 4 shows schematically a device for scarifying asphalt surfacing, FIG. 5 is a schematic lateral view of a combined bucket and scarifier with a first embodiment of a rotating means according to the invention, FIG. 6 is a view of the device according to FIG. 5 seen from the right in FIG. 5, where certain details of the bucket and scarifier have been excluded for the sake of clearness, and where, with respect to the bucket-scarifier, to the right in FIG. 6 the forward cylinder attachments and to the left in FIG. 6 the rearward cylinder attachments are shown, FIG. 7 shows schematically a detail from FIG. 6 where the bucket-scarifier has been rotated through about 90° by the rotating means according to the invention, FIG. 8 is a schematic lateral view of a combined bucket and scarifier with a second embodiment of the rotating means according to the invention, where the bucket-scarifier can be swung out in two lateral directions, and FIG. 9 is a view from the right in FIG. 8 of the bucket-scarifier with the rotating means according to FIG. 8.

In FIGS. 1 and 2 the numeral 1 designates a bottom plate of an attachment, by means of which the device according to the invention is intended to be attached to a digger arm of an excavator or corresponding machine. From the bottom plate two parallel side walls 2 extend upward, each of which includes two through holes 3 with mounting bushings 4. In said holes 3 two axles 5 extending in parallel with each other and perpendicularly to the side walls 2 and intended to co-operate with an attachment on the digger arm (not shown) are located and are locked in axial direction by means of cotters 6 through the bushings 4 and axle 5.

An attachment piece 8 attached to the bottom plate 1 and extendin downward from the lower surface 7 thereof transforms at its rear portion 9 to a frozen soil scarifier 10. The scarifier consists of a tooth-shaped arm, which at its tip 11 preferably is mounted with an exchangeable tooth 12 or the like.

13 designates a bucket comprising a rear edge 14 or bottom 14 and sides 15 and a lower edge 16 intended to penetrate into the ground or corresponding matter.

The bucket 13 includes at its rear edge 14 a vertical central groove 17 or the like, into which the scarifier 10 is intended to fit, so that the bucket 13 in digging position rests against the scarifier 10.

The bucket 13 is hingedly suspended at its upper rear portion 18 by means of an axle 19, which extends through an attachment 20, a mounting bushing 20, on each side 15 of the bucket and through the attachment piece 8 substantially in the place where the attachment piece transforms to the scarifier 10.

In order to fold the bucket upward in the direction from the scarifier, preferably two hydraulic cylinders 21 are located one on each side of the attachment piece 8. Each cylinder 21 acts between an attachment 22 in connection to the forward edge 23 of the bucket located in front of the attachment 20 for the axle 19, and an attachment 24 in connection preferably to the front portion 25 of the attachment piece 8. The attachment 22 consists of a bushing 26 mounted on the inside 27 of the side 15, a bushing 28 mounted by means of a stay member 29 in the bucket and an axle 30, against which the cylinder 21 acts. The attachment 24 consists of a bushing 31 mounted on the attachment piece 8, a transverse mounting box 32 with a side wall 33 provided with a hole, and an axle 34, against which the cylinder 21 acts.

The scarifier, FIGS. 1 and 2, can be provided at its rear edge with attachments 35 for a cable-laying device 56, which comprises one or more shafts extending substantially vertically and along the scarifier, which shaft downwardly deflects in the direction from the scarifier and joins the ground or corresponding matter, and into which a cable 37 is inserted above and runs out downwardly. By means of one embodiment of the cable-laying device it is possible, for example, to lay electric cables and telecommunication cables at a prescribed distance from and in parallel with each other as indicated in FIG. 2. The laying device also includes space, for example a separate shaft 38, for laying a protective strip 39 for the cable.

The laying device can also be designed with two shafts or shaft portions located to the side of each other in the digging direction, so that two cables can be laid in parallel with each other, but at different heights in the trench.

The device can also be completed by a device for cutting asphalt surfacing or the like, as shown schematically in FIGS. 3 and 4. In such a case a carrying arm 40 is provided which projects forward from, for example, the forward portion 25 of the attachment piece 8, and at the free end 41 of the arm 40 a circular cutter 42 is located. By rotating the attachment by means of the excavator, the cutter 42 can be engaged. After the cutting, the surfacing pieces can be collected with the bucket.

According to one embodiment, the bucket 15 and scarifier 10 are hingedly suspended at the attachment and rotatable in lateral direction in a plane substantially perpendicular to the plane, in which the bucket can be folded to and from the scarifier, where, as an embodiment, means for effecting this are shown in FIGS. 5–9. In FIG. 5 the numeral 43 designates a bottom plate or corresponding member of an attachment, which by means of mounting eyes 44 can be attached in known manner to a digger arm of an excavator or corresponding machine. 45 designates a support plate comprised at the upper portion of the scarifier 10 and intended to abut the bottom plate 43.

In FIGS. 5–7 the numeral 46 designates one long side of the bottom plate 43 where the long side extends substantially in parallel with the plane, in which the bucket can be folded. In connection to said long side 46 two stay members 47 are provided, each of which extends upward and slightly projects out from the bottom 43, the attachment 43,44, and preferably consists of two parallel stay member arms 48.

At the upper end 49 of each stay member 47 one end 50 of a hydraulic cylinder 51 is intended to be attached hingedly so that a cylinder 51 extends downward from each stay member 47. Said hinge consists, for example, of an axle 52 mounted on the stay member arms 48 and extending perpendicularly to the longitudinal direction thereof.

In connection to the lower end 55 of each stay member 47, an attachment piece 54 is located, where each attachment piece is located at and projects from the upper portion 8 of the scarifier and a long side 55 of the support plate 45. At the outer portion 56 of each attachment piece 54 the other end 57 of a cylinder 51 is intended to be hingedly attached, where each attachment piece 54 consists, for example, of two members 58 extending in parallel, between which members the cylinder 51 is attached by means of an axle 59. Each attachment piece, at its inner portion 60 located closest to the long side 55 of the support plate 45, also is hingedly connected to the lower end 55 of the respective stay member 47 by means of, for example, a sleeve 61, which is located on an axle 62 extending between the stay member arms 48 and perpendicularly to the longitudinal direction thereof. Here, thus, are provided the attachment with the sleeve 61 and the axle 62 between the attachment 43,44 and the attachment for the lower cylinder end 57 with the axle 59, so that the attachment piece 54, and therewith the scarifier 10 and bucket 13, can be rotated about the axle 62 by action of the cylinder 51.

The numeral 63 designates guide shoulders located at the support plate 45 and running substantially in the longitudinal direction of the plate, which shoulders 63 are intended to fit into longitudinal grooves 64 in the bottom plate 43. The guide shoulders, which preferably have a configuration tapering from the plate 45, and the grooves are shaped correspondingly, have the object to effect good stability at digging with the bucket and at the use of the scarifier. 65 designates support flanges, which are located on the long side of the plates 43,45 which is free from cylinders, stay members etc., and which by means of, for example, through holes 66 and bolts 67 are intended to additionally fix the plates 43,45 to each other when the possibility of rotating the bucket and scarifier by the cylinders 51 is not utilized.

At the embodiment shown in FIGS. 5–7 the bucket and scarifier are laterally rotatable only in one direction, to the left in FIGS. 6 and 7.

According to the embodiment shown in FIGS. 8 and 9 the bucket and scarifier are rotatable, capable to be swung out, in two directions, to the right as well as to the left in FIG. 9 in said plane.

The numeral 68 designates a hydraulic rotating means attached to the said bottom plate 43 and located beneath the same. The rotating means 68 is capable to rotate an axle 69 or corresponding member, which is located with its longitudinal direction substantially in parallel with the bottom plate 43 and substantially in the plane, in which the bucket 15 is foldable to and from the scarifier 10. The said axle 69 is mounted at the upper portion 8 of the scarifier, for example at a first attachment 70 projecting upward at the forward portion 71 of the scarifier portion 8, and a second attachment 72 located at the rearward portion 73 of the scarifier portion 8, where the rotating means 68 is located between said attachments 70,72. The axle 69 also is mounted in the rotating means.

The rotating means, which is not shown in detail and substantially is cylindric and of a kind known per se, comprises according to one embodiment two chambers, which can be expanded substantially in the circumferential direction of the axle 69 and can be filled with and tapped of a pressure medium, where a substantially tangential force directed in the circumferential direction is applied on the axle 69 when the pressure medium is filled into the first chamber, and a tangential, but opposedly directed force is applied on the axle 69 when pressure medium is filled into the second chamber, and where said forces in a neutral position, corresponding to the position when the bucket-scarifier are not rotated in lateral direction, can balance each other.

The rotating means also can be a so-called rotator of known type, by means of which the axle 69 can be rotated in two directions. The rotator, for example, is of the kind used for effecting rotation at the felling and laying at forestry machines.

The mode of operation of the device according to the invention should partly have become apparent from the above description. The bucket 13, thus, can be folded by the cylinders 21 between two positions. In a first position, FIG. 1, the digging position, the bucket rests against the scarifier 10 along the groove 17 whereby the scarifier is not engaged. In a second position, the folded-up position, the bucket has been rotated about the axle 19 and been moved forward and upward, so that the scarifier is exposed. Upon strokes of the cylinders the attachments 22 are moved to a position shown by dashed line in FIG. 1. The rear edge 14 of the bucket thereby assumes a position as indicated by dashed line in FIG. 1.

The mode of operation of the rotatable combined bucket and scarifier according to the embodiment in FIGS. 5–7 should substantially have become apparent from the above description. The rotation or outward swing-movement of the bucket-scarifier in lateral direction to a position corresponding to that in FIG. 7, thus, is effected in that the outer portion 56 of each attachment piece 54 is drawn upward by the respective cylinder 51, whereby the attachment pieces are rotated, and thereby the bucket-scarifier is rotated about the lower portion 53, the axles 62, of the stay members 47. This rotation should extend at least through 90° from the position in FIG. 6.

Also the mode of operation of the bucket-scarifier according to the embodiment shown in FIGS. 8 and 9 should substantially have become apparent from the above description. By means of the rotating device 68 the bucket-scarifier can be rotated, swung outward, via the axle 69 mounted at the upper portion 8 of the scarifier in lateral direction from the neutral position shown in FIG. 9, where the bucket-scarifier can be swung out at least through 90° in both directions, as indicated by dashed line in FIG. 9.

By a device according to the invention, thus, the bucket can rapidly and automatically, controlled from the driver's seat of an excavator, be folded between digging position and folded-up position. This, of course, saves especially much time and work for example at the laying of cables, particularly in wintertime.

By means of the attachment arrangement and cotters 6, the device can be turned rapidly relative to the excavator and be used for ploughing with the bucket or scarifier. Also single objects can be gripped between bucket and scarifier, by control from the driver's seat.

As also should have become apparent from the aforesaid, by designing also the bucket and scarifier automatically and simultaneously rotatable, a highly flexible and useful equipment, for example for line drawing inclusive of pole erection is obtained.

In the foregoing some embodiments of a device according to the invention have been described. It is, of course, possible to imagine minor changes and other embodiments without abandoning the idea of the invention.

The cylinders, for example, can be located at the forward portion 9 of the attachment piece 8 and hereby assume deflected position when the bucket assumes digging position. The attachment piece 8 may also be a separate part, to which the scarifier and the bucket are attached.

As regards the configuration of the bucket 13, a.c. in relation to the configuration of the scarifier 10, the following can be said. The width of the bucket, of course, can be varied within wide limits, depending on the field of application. The lower edge 16 of the bucket also may be provided with teeth of known type.

The bucket also may be given such length, that the lower edge or tip 11, 12 of the scarifier is located slightly beneath the lower edge 16 of the bucket when the bucket is in digging position, whereby the tip of the scarifier will be engaged simultaneously with the bucket. It is preferred that the lower edge of the bucket in digging position of the bucket is located in connection to the tip of the scarifier, such as slightly above, FIG. 1, or slightly below.

The groove 17 at the rear edge 14 of the bucket can be imagined to be replaced, at least along a portion of the rear edge 14 of the bucket, by a recess, a hole, in the bucket whereby, thus, the scarifier along a portion of its length will project into the bucket when the bucket is in digging position.

At the embodiment shown in FIGS. 8 and 9 where the swinging-out movement can take place in both directions, a hydraulically operated rotating means can be attained in a way other than by the hydraulic rotating device 68 described. For example, one or more hydraulic cylinders may be located on each side of the attachment, where the cylinders on each side actuate, for example via a link arm and gear ring, a gear ring located at the axle 69, so that the axle is rotated. Embodiments may also be imagined where the axle is rotated by at least one hydraulic motor, which for example via gearwheels is capable to rotate the axle.

It also can be imagined at the embodiment shown in FIGS. 8 and 9 to attach means of a suitable type for stabilizing the bucket-scarifier when the rotation function is not utilized. Flanges suitably mounted on the attachment 43,44 and upper portion 8 of the scarifier together with boltings may be used. It also can be imagined to use a hydraulically controlled interlocking against rotation, for example locking shoulders located at the attachment to fit into the upper portion 8 of the scarifier.

At the embodiment shown in FIGS. 5–7, of course, the number of cylinders can be varied. Also in this case the cylinder deflection can be imagined to be converted to a rotation movement by means of link arms and gear rings.

The invention, thus, must not be regarded to be restricted to the embodiments set forth above, but can be varied within the scope of the attached claims.

I claim:

1. A device providing a combined bucket and frozen soil scarifier (cable plough), where the bucket and the scarifier are intended to be attached to a digger arm of an excavator or corresponding machine and the width of the scarifier is substantially smaller than the width of the bucket, and the bucket in digging position rests at its rear edge against the scarifier, and at its upper portion is hingedly suspended by means of an axle or corresponding member, and by preferably hydraulic means, for example at least one hydraulic cylinder, can be folded in the direction from the scarifier, whereby the scarifier can be used without the bucket being engaged, characterized in that a common attachment (1–6, 43, 44) for the scarifier (10) and the bucket (13) provided and arranged, preferably by means of a quick-coupling arrangement (3–6) for attaching the bucket (13) and the scarifier to the digger arm as a unit, the scarifier (10) being rigidly attached to said attachment (1–6, 43, 44), and that two hydraulic cylinders (21) are provided, one on each side of an attachment piece (8) provided at the upper portion of the scarifier (1), each cylinder (21) acting between the attachment piece (8) and an attachment (22) in connection with the forward edge (23) of the bucket (13), so that the bucket (13) can be folded by means of the cylinders (21) between a first position, digging position, where the bucket rests against the scarifier (10), and a second position, folded-up position, where the bucket (13) has been rotated about the axle (19) and been moved forward and upward, so that the scarifier (10) is exposed, the bucket being foldable to any position between said first and second positions by means of the cylinders (21), and that the lower edge (14) of the bucket (13) in folded-down position, digging position, is located in connection to the lower edge (11, 12) of the scarifier (10) whereby the scarifier (10) and the bucket (13) are designed so that single objects, for example a log or a stone, can be gripped by co-action between the scarifier (10) and the bucket (13).

2. A device as defined in claim 1, characterized in that the bucket (13) is hingedly suspended by means of an axle (19), which extends through an attachment (20) on each side (15) of the bucket and through said attachment piece (8).

3. A device as defined in claim 1, characterized in that said common attachment (1–6, 43, 44) is arranged so that the bukcet (13) and the scarifier (10) together can swing to positions in a lateral arc of 180 degrees relative to the longitudinal disposition of the digger arm.

4. A device as defined in claim 1, characterized in that the scarifier (10) at preferably its rear edge comprises mountings (25) for cable laying equipment (36).

5. A device as defined in claim 1, characterized in that the scarifier (10) includes a means for cutting asphalt surfacing or the like, comprising a circular cutter (42).

6. A device as defined in any one of claims 1–5, characterized in that bucket (13) at its rear edge (14) comprises a vertical central groove (17), recess or the like, into which the scarifier (10) is intended to fit.

7. A device providing a combined bucket and frozen soil scarifier such as a cable plough, where the bucket and the scarifier are intended to be attached to a digger arm of an excavator or corresponding machine and the width of the scarifier is substantially smaller than the width of the bucket, and the bucket in digging position rests at its rear edge against the scarifier, and at its upper portion is hingedly suspended by means of an axle or corresponding member, and by hydraulic means, for example at least one hydraulic cylinder, can be folded in the direction from the scarifier, whereby the scarifier can be used without the bucket being engaged, characterized in that a common attachment for the scarifier and the bucket is provided and capable, by means of a quick-coupling arrangement, to be attached to the digger arm, the scarifier being attached to said attachment, and that two hydraulic cylinders are provided, one on each side of an attachment piece provided at the upper portion of the scarifier, each cylinder acting between the attachment piece and an attachment in connection to the forward edge of the bucket, so that the bucket can be folded by means of the cylinders between a first position, digging position, where the bucket rests against the scarifier, and a second position, folded-up position, where the bucket has been rotated about the axle and been moved forward and upward, so that the scarifier is exposed, that the lower edge of the bucket in folded-down position, digging position, is located in abutment with the lower edge of the scarifier whereby the scarifier and the bucket are designed so that single objects, for example a log or a stone, can be gripped by co-action between the scarifier and the bucket, and wherein said scarifier is together with the bucket, hingedly suspended at said attachment and can be rotated, swung outward, in lateral direction at least through 90° in at least one direction in a first plane substantially perpendicular to a second plane in which the bucket can be folded to and from the scarifier, where the rotation, outward swing movement, is intended to be effected preferably by hydraulic means, for example one or more hydraulic cylinders or hydraulic rotating means located at said attachment, whereby an object, for example a pole, gripped by means of the bucket and scarifier can be swung in a plane, for example, from a horizontal direction to a substantially vertical direction.

8. A device as defined in claim 7, characterized in that said attachment (43,44) comprises a bottom plate (43) or corresponding member, to which a preferably hydraulically operated rotating means (68) is attached, which is capable to rotate an axle (69) or corresponding member, which is mounted with its longitudinal direction substantially in parallel with the bottom plate (43) and substantially in the plane, in which the bucket (13) can be folded to and from the scarifier (10), so that the bucket (13) by means of the rotating means (68) can be rotated, swung outward, via the axle (69) in lateral direction through at least 90° in both directions from said plane, in which the bucket (13) is swung.

9. A device as defined in claim 8, wherein the rotating means is driven hydraulically, characterized in that the rotating means (68) is a kind known per se and comprises two chambers capable to be expanded substantially in the circumferential direction of the axle (69) and to be filled with and exhausted of a pressure medium, where a substantially tangentially directed force chamber and a substantially tangential force, but in opposed direction, is applied to the axle (69) when pressure medium is filled into the second chamber, and where said forces in a netural position, corresponding to that in which the bucket (13)-scarifier (10) are not rotated in lateral direction can balance each other.

10. A device as defined in claim 8, wherein the rotating means is hydraulically driven, characterized in that the rotating means is a so-called rotator of known type, by which the axle (69) can be rotated in both directions.

11. A device as defined in claim 7, characterized in that at one long side of a bottom plate (43) or corresponding member comprised in said attachment (43,44) preferably two stay members (47) are provided, where each stay member (47) projects upward and slightly out from the attachment (43,44) and preferably consists of two parallel stay member arms (48), where one end (50)

of a hydraulic cylinder (51) is intended to be hingedly attached to the upper end (49) of the stay member (47), wherein attachment piece (54) support means are located at and project out from the upper portion (8) of the scarifier (10) and a support plate (45) comprised in the upper portion (8) of the scarifier (10) and at its inner portion located closest to the support plate (45) is hingedly connected to the lower end (53) of the respective stay member (47), so that the bucket (13) and scarifier (10), via said attachment pieces (43,44) and can be rotated, swung outward, in said first plane at least through 90° in substantially one direction from the second plane in which the bucket can be folded and so that the support plate (45) in the position not swung out joins said bottom plate (43) or corresponding member.

12. A device as defined in claim 7, characterized in that the bucket is hingedly suspended by means of an axle, which extends through an attachment on each side of the bucket and through said attachment piece.

13. A device as defined in claim 7, characterized in that said common attachment is arranged so that the bucket and the scarifier together can swing to positions in a lateral arc of 180 degrees relative to the longitudinal disposition of the digger arm.

14. A device as defined in claim 7, characterized in that the scarifier at preferably its rear edge comprises mountings for a cable laying equipment.

15. A device as defined in claim 7, characterized in that the scarifier includes a means for cutting asphalt surfacing or the like, comprising a circular cutter.

* * * * *